US006004151A

United States Patent [19]

Hashiguchi

[11] Patent Number: 6,004,151

[45] Date of Patent: Dec. 21, 1999

[54] PCB EDGE RECEIVING ELECTRICAL CONNECTOR OF ZIF TYPE WITH FPC CONTACTS

[75] Inventor: Osamu Hashiguchi, Hamura, Japan

[73] Assignee: Japan Aviation Electronics Industry, Limited, Tokyo, Japan

[21] Appl. No.: 08/980,048

[22] Filed: Nov. 26, 1997

[51] Int. Cl.[6] ..... H01R 13/15

[52] U.S. Cl. ..... 439/260

[58] Field of Search ..... 439/260, 62, 67, 439/77, 632

[56] References Cited

U.S. PATENT DOCUMENTS 2,857,577 10/1958 Vanderpool ..... 439/260

5,679,018 10/1997 Lopata et al. ..... 439/260

*Primary Examiner*—Lincoln Donovan

*Assistant Examiner*—Eugene G. Byrd

*Attorney, Agent, or Firm*—J. Warren Whitesel; Laff, Whitesel & Saret, Ltd.

[57] ABSTRACT

An electrical connector for electrically connecting a printed circuit board (PCB) to an electrical device, comprising a lower insulator mounted on the electrical device and an upper insulator relatively movable to the lower insulator. The upper insulator has a groove for receiving a board edge of PCB and a flexible printed circuit (FPC) having an end adjacent to the groove and a elastic urging plate. The FPC extends through the lower insulator and connect ed to the electrical device. The elastic urging member is bent into a "V" shape and is brought into contact with an inclined surface formed on the lower insulator when the upper insulator is moved towards the lower insulator. Thus, the bent portion of the urging member pushes the end of FPC into the groove to establish contact connection of conductors of the FPC with pads on the PCB. Thus, connection and disconnection of PCB with the edge connector can be made without insertion and removal force against the contact force between the pads and the FPC.

4 Claims, 4 Drawing Sheets

PCB EDGE RECEIVING ELECTRICAL CONNECTOR OF ZIF TYPE WITH FPC CONTACTS

BACKGROUND OF THE INVENTION

This invention relates to an electrical connector for electrically connecting a printed circuit board to an electrical device, and, in particular to an edge connector for receiving a board edge portion of a printed circuit board to connect pads formed on a surface of the board edge portion to an electrical device such as another printed circuit board.

In a prior art, there is well known an edge connector of a type described above which comprises an insulator having a board receiving groove for receiving a board edge portion, and a plurality of contacts fixedly mounted in the insulator. The insulator is mounted on an electrical device to be connected with the printed circuit board. Each of the plurality of contacts is made of metal plate to have a fitting portion to be fixedly fitted to the insulator, a contact portion cantilevered at the fitting portion and extending to the board receiving groove, and a terminal portion extending from the fitting portion outside the insulator for connecting with the electrical device.

Under a condition where the electrical connector is mounted on the electrical device, when the board edge portion of the printed circuit is inserted into the board receiving groove, each of pads formed on the board edge portion comes into contact with the contact portion of each of the contacts. Thus, the printed circuit board is electrically connected to the electrical device through the contact between the pad and the contact.

In order to insure a reliable sufficient contact force between the pad and the contact portion, the contact portion is partially protruded into the board receiving groove so that the cantilevered contact portion is elastically deformed by the board edge portion inserted into the board receiving groove. The elastic recovering force of the deformation provides the contact force.

In the known edge connector, there needs any insertion force for inserting the board edge portion into the board receiving groove to deform the contacts. The insertion force is increased as the number of pads and contacts is increased, resulting in difficulty of the insertion of the board edge portion. Applicatton of large insertion force often deforms the printed circuit board to result in break of the printed circuit. Further, when the board edge is inserted into the board receiving groove, friction force is caused between the printed circuit board and the contact portion. This often results in wear of the printed circuit board itself and pads formed thereon.

SUMMARY OF THE INVENTION

Therefore, it is an object of this invention to provide an edge connector of a ZIF (zero-insertion force) type wherein a board edge portion of a printed circuit board can be inserted into a board receiving groove of the connector without engaging with contacts but brought into contact with the contacts with a sufficient contact force between the pads and the contacts at completion of insertion of the board edge portion into the board receiving groove.

It is another object of this invention is to provide an edge connector of the ZIF type having a simple construction.

This invention is applicable to an electrical connector for electrically connecting a printed circuit board to an electrical device, the printed circuit board having at least one pad formed thereon at its one board edge portion. The electrical connector according to this invention comprises: a first insulator to be mounted on the electrical device and having a first surface and a first hole formed therein; a second insulator movable relative to the first surface of the first insulator in a first direction perpendicular to the first surface, the second insulator having a top surface and a lower surface opposite to the top surface in the first direction, the lower surface facing the first surface of the first insulator, the second insulator having a board receiving groove formed in the top surface for receiving the board edge portion inserted thereinto in the first direction, the second insulator having a through-hole formed in a side wall of the board receiving groove to open at the lower surface; a flexible flat member having opposite first and second ends and disposed to extend within the through-hole and the first hole with the first end being disposed adjacent to the board receiving groove while the second end being lead out from the first insulator, the flexible flat member having at least one conductor extending therealong from the first end to the second end for coming into contact, at the first end, with the at least one pad of the printed circuit board received in the board receiving groove and establishing, at the second end, an electrical connection with the electrical device; and an urging member disposed in the through-hole and extending towards the first insulator so that when the second insulator is moved towards the first insulator, the urging member comes into contact with the first insulator to be thereby driven to urge the first end of the flexible flat member into the board receiving groove to establish the electrical connection between the conductor and the pad.

The urging member is preferably made of an elastic plate which is bent to have a section of a generally "V" shape, an end of a first leg of "V" being fixed in an inner surface of the through-hole, the other second leg extending towards the first hole, the first end of the flexible flat member fixed to a bent portion of "V".

According to one aspect, the first hole is enlarged upward to form an inclined bole side surface, the end of the leg of "V" of the urging member is brought into contact with the inclined hole side surface of the first hole and slides thereon when the second insulator is moved towards the first insulator, whereby the bent portion urges the first end of the flexible flat member into the board receiving groove.

According to another aspect, the first insulator has a relatively large space formed therein continuous to the first hole in the first direction to thereby permit the flexible flat member to be folded therein in zigzag form when the second insulator is moved towards the first insulator.

BRIEF DESCRIPTION OR THE DRAWINGS

Figure 3:
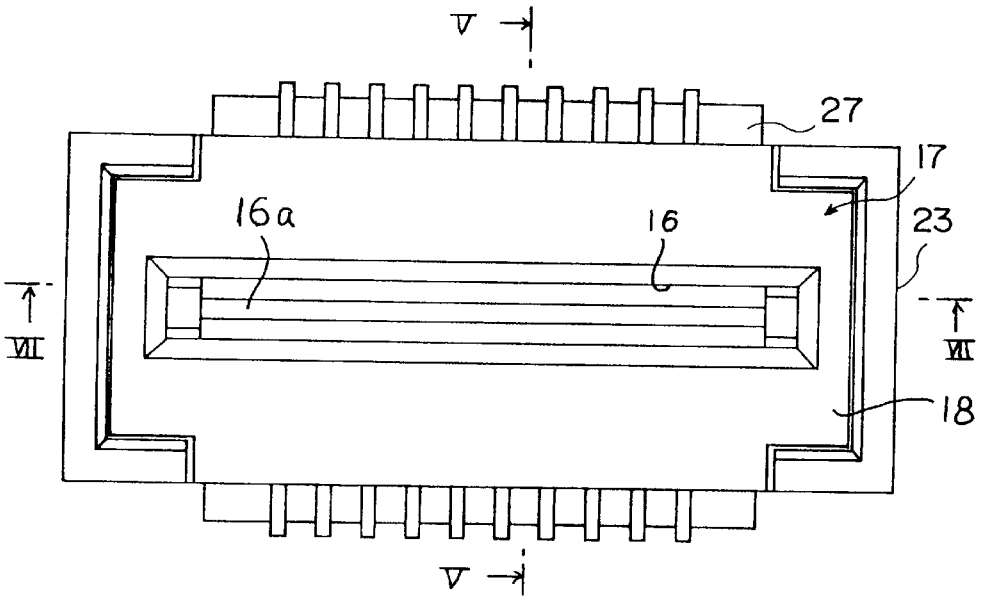
FIG. 3 is a plan view of an edge connector according to an embodiment of this invention.
Figure 5:
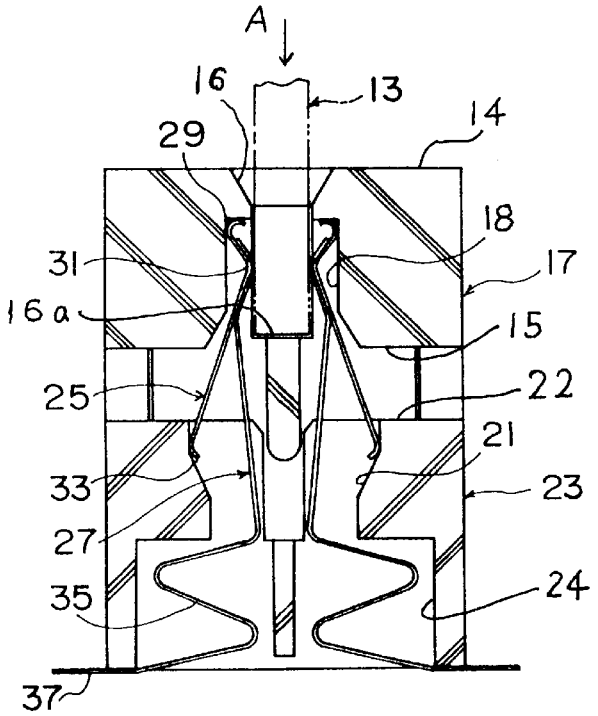
FIG. 5 is a sectional view of the edge connector taking along a line V—V in FIG. 3, illustrating a state before receiving the board edge portion of the printed circuit board of FIG. 2.
Figure 6:
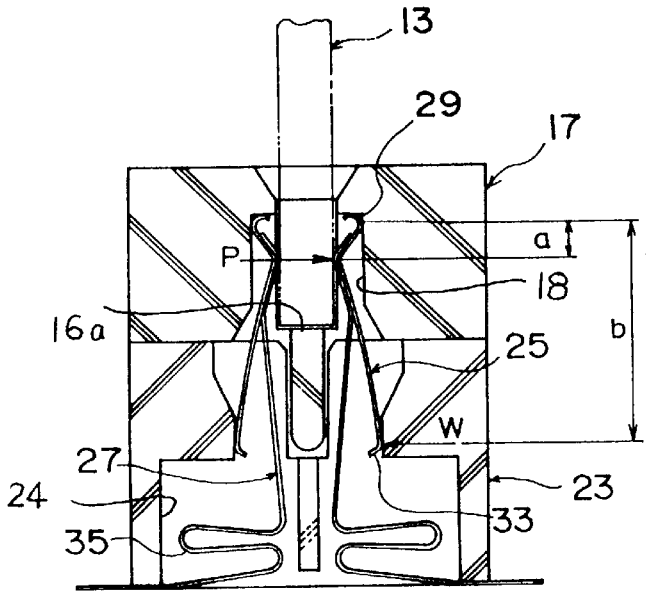
FIG. 6 is a sectional view similar to FIG. 5, but illustrating another state after the board edge portion is received therein and brought into contact with contact patterns of the edge connector.
Figure 7:
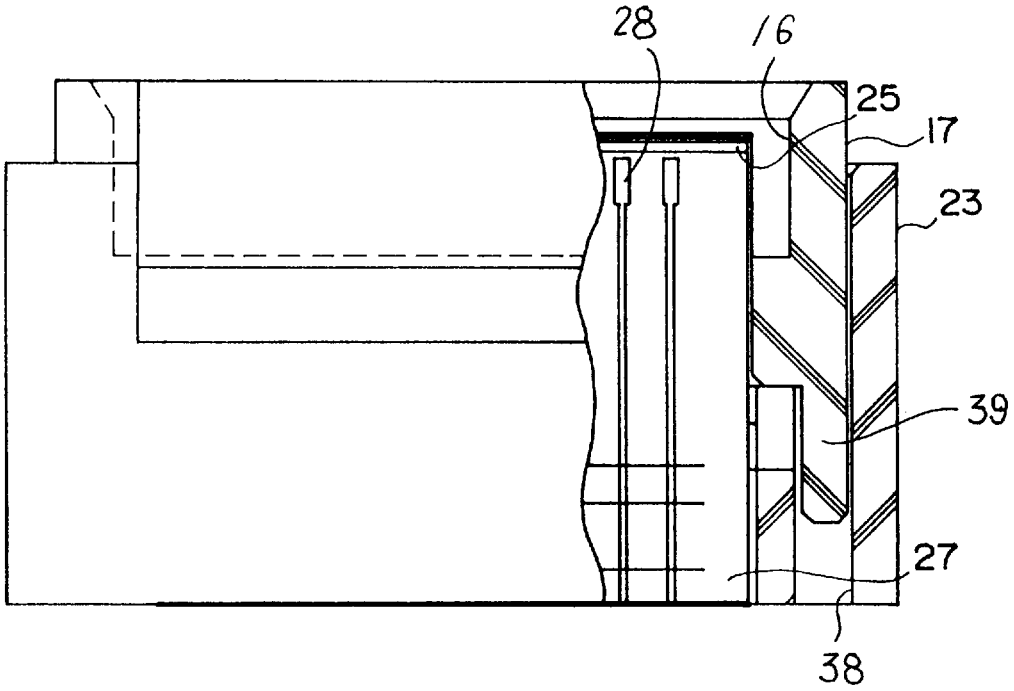
Figure 8:
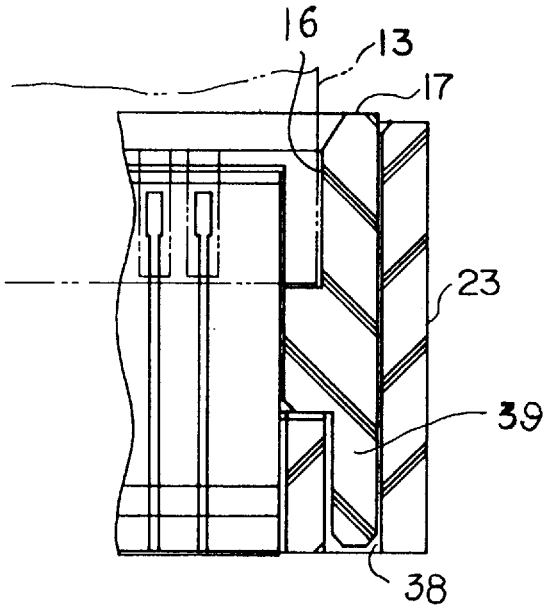

FIG. 7 is a sectional view of the edge connector taking along a line VII—VII in FIG. 3. illustrating the same state of FIG. 5 before receiving the board edge portion of the printed circuit board; and FIG. 8 is a sectional view similar to FIG. 7, but illustrating the same state of FIG. 6 after the board edge portion is received therein and brought into contact with contact patterns of the edge connector.

DESCRIPTION OF PREFERRED EMBODIMENTS

Prior to description of preferred embodiments of this invention, a edge connector will be described with reference to FIGS. 1 and 2 for support of better understanding of this invention.

Figure 1:
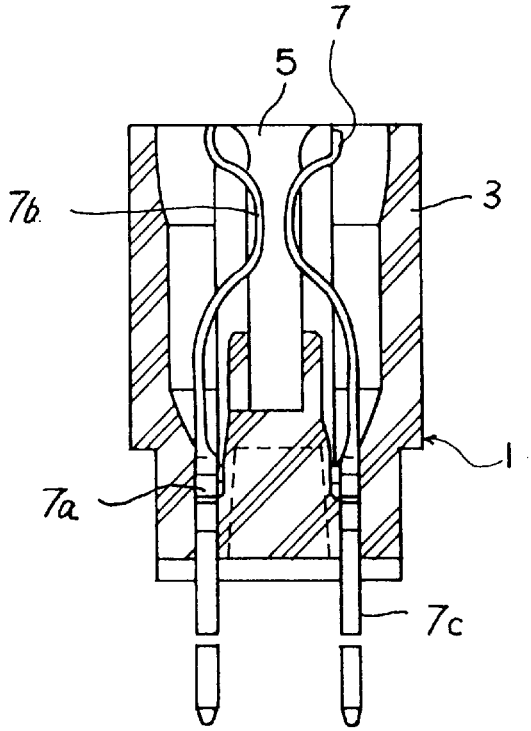
FIG. 1 PRIOR ART
FIG. 1 is a sectional view illustrating a structure of a known edge connector.
Figure 2:
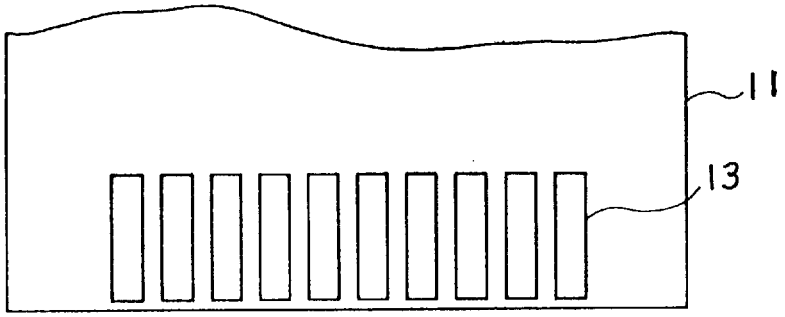
FIG. 2 PRIOR ART
FIG. 2 is a plan view of a board edge portion of a known printed circuit board applied to an edge connector.

Referring to FIG. 1, a known edge connector 1 shown therein comprises an insulator 3 having a board receiving groove 5 for receiving a board edge portion of a printed circuit board (PCB) shown in FIG. 2. A plurality of contacts 7 are fixedly mounted in the insulator 3. Each of the plurality of contacts 7 is made of metal plate to have a fitting portion 7*a* to be fixedly fitted to the insulator 3, a contact portion 7*b*cantilevered at the fitting portion 7*a* and extending to the board receiving groove 5, and a terminal portion 7*c* extending from the fitting portion 7*a* outside the insulator 3 for connecting with the electrical device such as another printed circuit board (not shown).

Referring to FIG. 2, the printed circuit board 11 has a plurality of pads 13 on its surface at its one edge portion. Those pads 13 are corresponding to contacts 7 of the edge connector 1.

Usually, PCB 11 has pads 13 on both surfaces thereof, although one surface is only shown in FIG. 2. Thus, contacts 7 are also arranged at opposite sides of the board receiving groove 5.

In use of the edge connector, the edge portion is inserted into the board receiving groove 5 to bring those pads 13 into contact with the corresponding contacts 7. Thus, the PCB 11 is electrically connected to the electrical device on which the edge connector 1 is mounted with electrical connection.

However, the known edge connector has the problems as described in the preamble of the present description.

Now, referring to FIGS. 3–8, an edge connector according to one embodiment of this invention will be described below.

Figure 4:
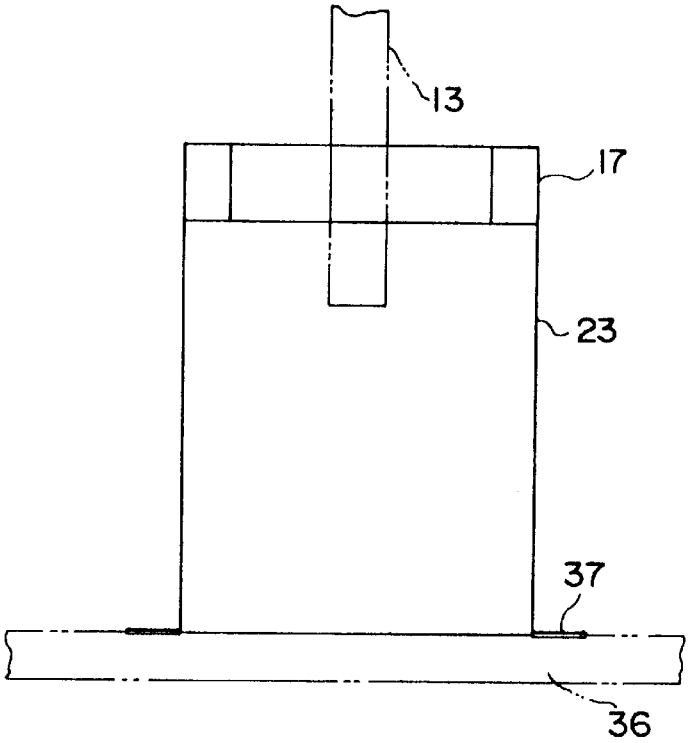
FIG. 4 is a side view of the edge connector of FIG. 3.

The edge connector shown in the figures is for establishing an electrical connection between the PCB 11 (FIG. 2) and an electrical device 36 such as another printed circuit board (FIG. 4). The edge connector comprises a first insulator or a lower insulator 23 to be mounted on the electrical device 36 and having a first or upper surface 22 and a first hole 21 formed in the upper surface 21.

A second or upper insulator 17 is disposed on and combined with the lower insulator 23 to be movable relative to the first surface 22 in a first direction shown at an arrow A in FIG. 5 perpendicular to upper surface 22. The upper insulator 17 has a top surface 14 and a lower surface 15 opposite to the top surface 14 in the first direction A. The lower surface 15 faces the first surface 22 of the lower insulator 23. The upper insulator 17 has a board receiving groove 16 formed in the top surface 14 for receiving the board edge portion of PCE 11 inserted thereinto in the first direction A. The second insulator 17 is also provided with a pair of through-holes 18 formed in opposite side walls of the board receiving groove 16 to open at the lower surface 15.

A pair of flexible flat members 27 each having opposite first and second ends are disposed to extend within the pair of through-holes 18, respectively into the first hole 21. The first end each of the flexible flat members 27 is disposed adjacent to the board receiving groove 16 while the second end is lead out from the lower insulator 23. Each of the flexible flat members 27 has a plurality of conductors 28 (see FIG. 7) extending therealong from the first end to the second end in parallel with each other. That is, the flexible flat member 27 with the conductor 28 is formed as a flexible printed circuit (PPC) or flexible flat cable (FFC). Each of the conductors 28 is for coming into contact, at the first end, with corresponding ones of the pads 13 on corresponding one of surfaces of the board edge portion of PCB 11 received in the board receiving groove 16 and establishing, at the second end, an electric connection 37 with the electrical device 36

If PCB 11 has all pads 13 on single one of opposite surfaces thereof, the FPC FFC 27–28 may be only disposed at a corresponding one of opposite sides of the board receiving groove 16.

A pair of urging members 25 are also disposed in the pair of through-holes 18, respectively, and extend towards the lower insulator 23. The urging member 25 is made of an elastic plate which is bent to have a section of a generally "V" shape. An end 29 of a first leg of "V" is fixed in an inner surface of the corresponding one of the through-holes 18, and the other second leg extends towards the first hole 21. The first end of the corresponding one of the flexible flat member 27 is fixed to a bent portion 31 of "V" of the urging member 25.

When the upper insulator 17 is moved towards the lower insulator 23, each of the urging members 25 comes into contact with the lower insulator 23 and is thereby driven to urge the first end of the corresponding one of the flexible flat members 27 into the board receiving groove 16 to establish the electrical connection between the conductor 28 and the corresponding ones of the pads 13.

In detail, the first hole 21 is enlarged upward to form an inclined hole side surface. A lower end 33 of the leg of "V" of the urging member 25 is brought into contact with the inclined hole side surface of the first hole 21 and slides thereon when the upper insulator 17 is moved towards the lower insulator 23. Therefore, the bent portion 31 urges the first end of the flexible flat member 27 into the board receiving groove 16.

Further, the lower insulator 23 has a relatively large space 22 formed therein continuous to the first hole 21 in the first direction A to thereby permit the flexible flat member 27 to be folded therein in zigzag form as shown at 35 in FIG. 6 when the upper insulator 17 is moved towards the lower insulator 23.

In the structure of the edge connector as described above, when PCB 11 is inserted into the board receiving groove 16 as shown in FIG. 5, the flexible flat members 27 do not protrude into the board receiving groove 16. Therefore, the insertion of PCS 11 can be inserted into the board receiving groove 16 without insertion force. Then, PCB 11 is further pushed down In the direction A, the leading edge of PCB 11 is engage with a bottom 16*a* (FIGS. 3, 5 and 6) of the board receiving groove 16. Thus, the upper insulator 17 is pushed down towards the lower insulator 23. As a result, the bent portions 31 of the urging members 25 drive the upper ends of flexible members 27 into the board receiving groove 16, so that the conductors 28 of the flexible members 27 are pushed onto pads 13 on PCB 11, as described above. This contact condition is shown in FIG. 6.

In the contact condition, a moment by a contact force P between PCB 11 and the urging member 25 at bent portion 31 generally balances with another moment by another contact force W between the lower end of the urging member 25 and an inner wall of the first hole 21. That is, $(w \times b)=(P \times a)$. Symbols "a" and "b" are shown in FIG. 6.

Thus, W can be made far smaller than P by bending the urging member 25 near the upper end thereof to realize $b \gg a$. Thus, the force is very small to be required for the connection and disconnection between PCB 11 and edge connector.

In FIGS. 5 and 6, the first hole 21 is preferably formed cylindrical at its lower end portion to which the lower end 33 of the urging member 25 is brought into contact when the upper insulator 17 is completely pushed down to the lower insulator 23 to establish electrical connection of PCB 11 and the edge connector. Thus, the upper insulator 17 is prevented from being pushed up by the contact force W between the lower end of the urging member 25 and an inner wall of the first hole 21.

Further, upper insulator 17 and lower insulator 23 are guided by the vertical groove 38 and flange 39 slidingly fixed to each other as shown in FIGS. 7 and 8 and thereby slidingly and relatively move in the direction A without undesired inclination from the direction A.

What is claimed is:

1. An electrical connector for electrically connecting a printed circuit board to an electrical device, said printed circuit board having at least one pad formed thereon at its one board edge portion, which comprises:

a first insulator to be mounted on said electrical device and having a first surface and a first hole formed therein:

a second insulator movable relative to said first surface of said first insulator in a first direction perpendicular to said first surface, said second insulator having a top surface and a lower surface opposite to said top surface in said first direction, said lower surface facing said first surface of said first insulator, said second insulator having a board receiving groove formed in said top surface for receiving said board edge portion inserted thereinto in said first direction, said groove having bottom and side surfaces, said board edge being inserted in said groove with said edge fitting against said bottom surface, said second insulator having a through-hole formed in a side wall of said board receiving groove to op en at said lower surface;

a flexible flat member having opposite first and second ends and disposed to extend within said through-hole and said first hole with said first end being disposed adjacent to said board receiving groove with said second end being led out, from said first insulator, said flexible flat member having at least one conductor extending there along from said first end to said second end for coming into contact, at said first end, with said at least one pad of said printed circuit board received in said board receiving groove and establishing at said second end, an electric connection with said electrical device, and an urging member disposed in said through-hole and extending towards said first insulator so that, when said second insulator is moved towards said first insulator, said urging member comes into contact with said first insulator to be thereby driven to urge said first end of said flexible flat member into said board receiving groove to establish said electrical connection between said conductor and said pad.

2. The electrical connector as claimed in claim 1, wherein said urging member is made of an elastic plate which is bent to have a section of a generally "V" shape, an end of a first leg of "V" being fixed in an inner surface of said through-hole, the other second leg extending towards said first hole, said first end of said flexible flat member fixed to a bent portion of "V".

3. The electrical connector as claimed in claim 2, wherein said first hole is enlarged upward to form an inclined hole side surface, the end of said leg of "V" or said urging member is brought into contact with said inclined hole side surface of said first hole and slides thereon when said second insulator is moved towards said first insulator, whereby said bent portion urges said first end of said flexible flat member into said board receiving groove.

4. The electrical connector as claimed in claim 1, wherein said first insulator has a relatively large space formed therein continuous to said first hole in said first direction to thereby permit said flexible flat member to be folded therein in zigzag form when said second insulator is moved towards said first insulator.

* * * * *

UNITED STATES PATENT AND TRADEMARK OFFICE

CERTIFICATE OF CORRECTION

PATENT NO. : 6,004,151
DATED : December 21, 1999
INVENTOR(S) : Osamu Hashiguchi

It is certified that error appears in the above-identified patent and that said Letters Patent is hereby corrected as shown below:

Column 1, Line 40, delete "any" and insert --an--;

Column 2, Line 21, delete "the" (second occurrence);

Column 3, Line 24, insert a space between 7b and cantilevered;

Column 3, Line 50, insert --1-- after connector;

Column 3, Line 64, delete "PCE" and insert --PCB--;

Column 4, Line 57, delete "PCS" and insert --PCB--;

Column 4, Line 59, delete "In" and insert --in--.

Signed and Sealed this

Tenth Day of October, 2000

*Attest:*

Q. TODD DICKINSON

*Attesting Officer*

*Director of Patents and Trademarks*